US010326232B2

(12) United States Patent
Sone et al.

(10) Patent No.: US 10,326,232 B2
(45) Date of Patent: Jun. 18, 2019

(54) CONNECTOR CONNECTING MEMBER ENABLING HOLDING-SIDE CONNECTORS TO BE CONNECTED EASILY TO DEVICE-SIDE CONNECTORS

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Kosuke Sone, Mie (JP); Yuji Kawashima, Mie (JP)

(73) Assignees: AutoNetworks Technologies, Ltd, Yokkaichi, Mie (JP); Sumitomo Wiring Systems, Ltd., Yakkaichi, Mie (JP); SUMITOMO ELECTRIC INDUSTRIES, LTD., Osaka-shi, Osaka (JP)

( * ) Notice: Subject to any disclaimer, the term of this patent is extended or adjusted under 35 U.S.C. 154(b) by 19 days.

(21) Appl. No.: 15/763,537

(22) PCT Filed: Sep. 9, 2016

(86) PCT No.: PCT/JP2016/076539
§ 371 (c)(1),
(2) Date: Mar. 27, 2018

(87) PCT Pub. No.: WO2017/056912
PCT Pub. Date: Apr. 6, 2017

(65) Prior Publication Data

US 2018/0219321 A1 Aug. 2, 2018

(30) Foreign Application Priority Data

Sep. 30, 2015 (JP) ..... 2015-192378

(51) Int. Cl.
*H01R 13/518* (2006.01)
*H01R 13/631* (2006.01)
(Continued)

(52) U.S. Cl.
CPC ..... *H01R 13/518* (2013.01); *H01R 13/631* (2013.01); *H01R 13/639* (2013.01);
(Continued)

(58) Field of Classification Search
CPC ..... H01R 13/518; H01R 13/659
(Continued)

(56) References Cited

U.S. PATENT DOCUMENTS

2005/0282426 A1* 12/2005 Nagashima ..... H01R 13/6315 439/374

FOREIGN PATENT DOCUMENTS

JP 2001-006808 1/2001
JP 2006-004840 1/2006
(Continued)

OTHER PUBLICATIONS

International Search Report dated Nov. 1, 2016.

*Primary Examiner* — Abdullah A Riyami
*Assistant Examiner* — Justin M Kratt
(74) *Attorney, Agent, or Firm* — Gerald E. Hespos; Michael J. Porco; Matthew T. Hespos

(57) ABSTRACT

A connector connecting member (10) is used to connect holding-side connectors (60) to device-side connectors (80) respectively provided in solenoids (90) serving as a plurality of electrical devices, and configured as a plate (11) including connector holding portions (12) and restrictions (13). A plurality of the connector holding portions (12) are arranged side by side in a direction intersecting a connecting direction. The restrictions (13) are arranged adjacent to the connector holding portions (12), restrict movements of the
(Continued)

solenoids (90) by coming into contact with the solenoids (90) and align the holding-side connectors (60) at positions connectable to the device-side connectors (80).

5 Claims, 11 Drawing Sheets

(51) Int. Cl.
*H01R 13/639* (2006.01)
*H01R 33/76* (2006.01)
*H01R 43/20* (2006.01)
*H01R 13/659* (2011.01)

(52) U.S. Cl.
CPC ..... *H01R 33/7664* (2013.01); *H01R 43/20* (2013.01); *H01R 13/659* (2013.01)

(58) Field of Classification Search
USPC ..... 439/540.1, 355
See application file for complete search history.

(56) References Cited

FOREIGN PATENT DOCUMENTS

| | | |
|---|---|---|
| JP | 2010-267488 | 11/2010 |
| JP | 5303378 | 6/2013 |
| JP | 2014-127308 | 7/2014 |

* cited by examiner

CONNECTOR CONNECTING MEMBER ENABLING HOLDING-SIDE CONNECTORS TO BE CONNECTED EASILY TO DEVICE-SIDE CONNECTORS

BACKGROUND

Field of the Invention

The invention relates to a connector connecting member for connecting holding-side connectors to device-side connectors and a connector connecting structure obtained by the connector connecting member.

Description of the Related Art

Japanese Patent No. 5303378 discloses an outer housing to be fixed to a case. The outer housing includes a tubular accommodating portion for accommodating an inner housing. Springs are arranged between an inner wall of the accommodating portion and the inner housing for displaceably accommodating the inner housing. The springs absorb a displacement between the inner housing and the mating connector.

If the mating connector is provided in an electrical device and the electrical device is in a state movable beyond a resilient range of the springs, it is difficult for the inner housing to reach a position where the inner housing is connectable to the mating connector and it may not be possible to perform a connecting operation smoothly. Further, a, workload is large if an attempt is made to connect the inner housing to each of the mating connectors when plural mating connectors are arranged side by side.

The invention was completed based on the above situation and aims to provide a connector connecting member and a connector connecting structure enabling holding-side connectors to be easily connected to device-side connectors.

SUMMARY

The invention is directed to a connector connecting member for connecting holding-side connectors to device-side connectors provided in a plurality of electrical devices. The connector connecting member includes connector holding portions arranged side by side in a direction intersecting a connecting direction of the device-side connectors and the holding-side connectors and is configured to hold the holding-side connectors. Restrictions are arranged adjacent to the connector holding portions and are configured to restrict movements of the electrical devices by contacting with the electrical devices and align the holding-side connectors at positions connectable to the device-side connectors.

The holding-side connectors are held by the connector holding portions and, in that state, the connector connecting member is brought closer to the respective device-side connectors. Thus, the respective holding-side connectors can be connected collectively to the respective device-side connectors. In this case, the restrictions of the connector connecting member restrict the movements of the electrical devices by contacting the electrical devices and the holding-side connectors are aligned at the positions connectable to the device-side connectors. Thus, a connecting operation of the connectors can be performed quickly and easily.

The restrictions may be arranged at both sides across the connector holding portions. The restrictions reliably restrict movements of the electrical devices. Further, this does not particularly complicate a structure.

The connector connecting member may comprise a plate, and the connector holding portions are recesses open at intervals on one side edge of the plate. The restricting portions project along plate surfaces of the plate from another side edge facing the one side edge. The connector holding portions and the restriction have a simple structure and are provided collectively on the plate. Thus, the structure of the connector connecting member need not become complicated and interference between the connector connecting member and peripheral components can be avoided easily.

The connector connecting member may be moved toward the device-side connectors in a connecting process with the holding-side connectors held by the connector holding portions, and the restrictions may have stopper surfaces for stopping a movement of the connector connecting member by contacting the electrical devices. The contact of the stopper surfaces of the restricting portions and the electrical devices prevents the separation of the connector connecting member and the holding-side connectors from the device-side connectors.

The holding-side connectors held by the connector holding portions in the connector connecting member may be connected to the corresponding device-side connectors. According to this configuration, the holding-side connectors can be maintained in an aligned state after being connected to the corresponding device-side connectors.

DETAILED DESCRIPTION

Figure 1:
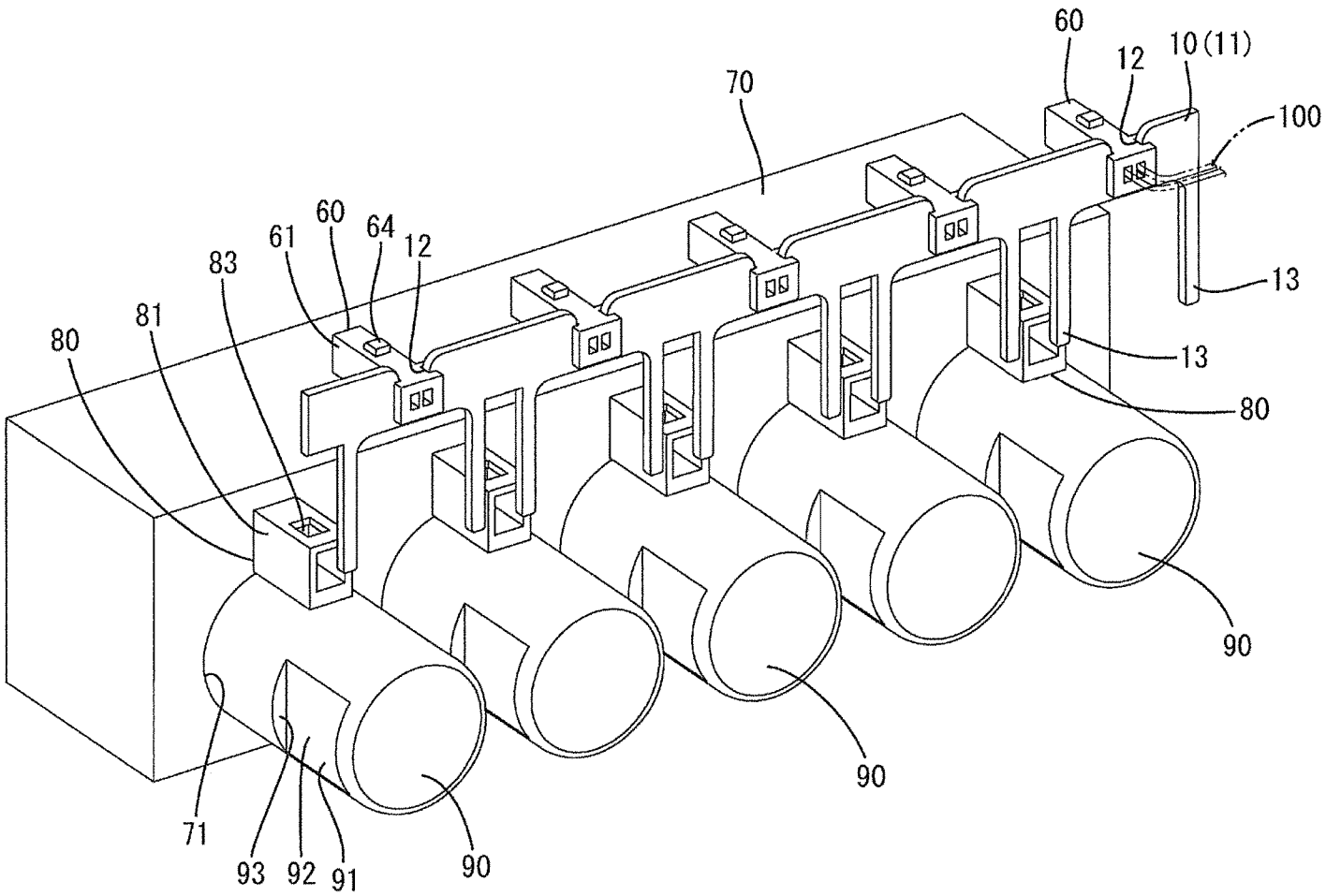
FIG. 1 is a perspective view showing a state before holding-side connectors are held by a connector connecting member and connected to device-side connectors provided in electrical devices in one embodiment of the present invention.

An embodiment of the invention is described with reference to FIGS. 1 to 11. The embodiment illustrates a connector connecting member 10 for holding holding-side connectors 60 as connection partners of device-side connectors 80 provided in solenoids 90 (electrical devices) and collectively connecting the respective holding-side connectors 60 to the corresponding device-side connectors 80, and a connector connecting structure using the connector connecting member 10. In the following description, a vertical direction is based on a use state (see FIGS. 1 to 4) and corresponds to a direction of gravity. Further, a front-rear direction is a direction in which the holding-side connectors 60 and the device-side connectors 80 are connected to each other (connecting direction), and a side of each holding-side connector 60 facing the corresponding device-side connector 80 at the start of connection is referred to as a front side.

The solenoid 90 is mounted in an automatic transmission of an automotive vehicle to control a hydraulic pressure. The automatic transmission includes a body 70 (including a case of the automatic transmission) as shown in FIG. 1, and solenoids 90 are assembled side by side in a width direction (lateral direction of FIG. 4). Note that the width direction of this embodiment is a direction intersecting the connecting direction of the connectors 60, 80 and means a juxtaposition direction of the respective solenoids 90 and the respective holding-side connectors 60. The solenoid 90 is cylindrical and is inserted into a valve inserting portion 71 open in the front surface of the body 70. The solenoid 90 inserted into the valve inserting portion 71 is fixed to the body 70 by a fixing tool such as an unillustrated pin, but is rotatable about an axis to some extent.

Figure 7:
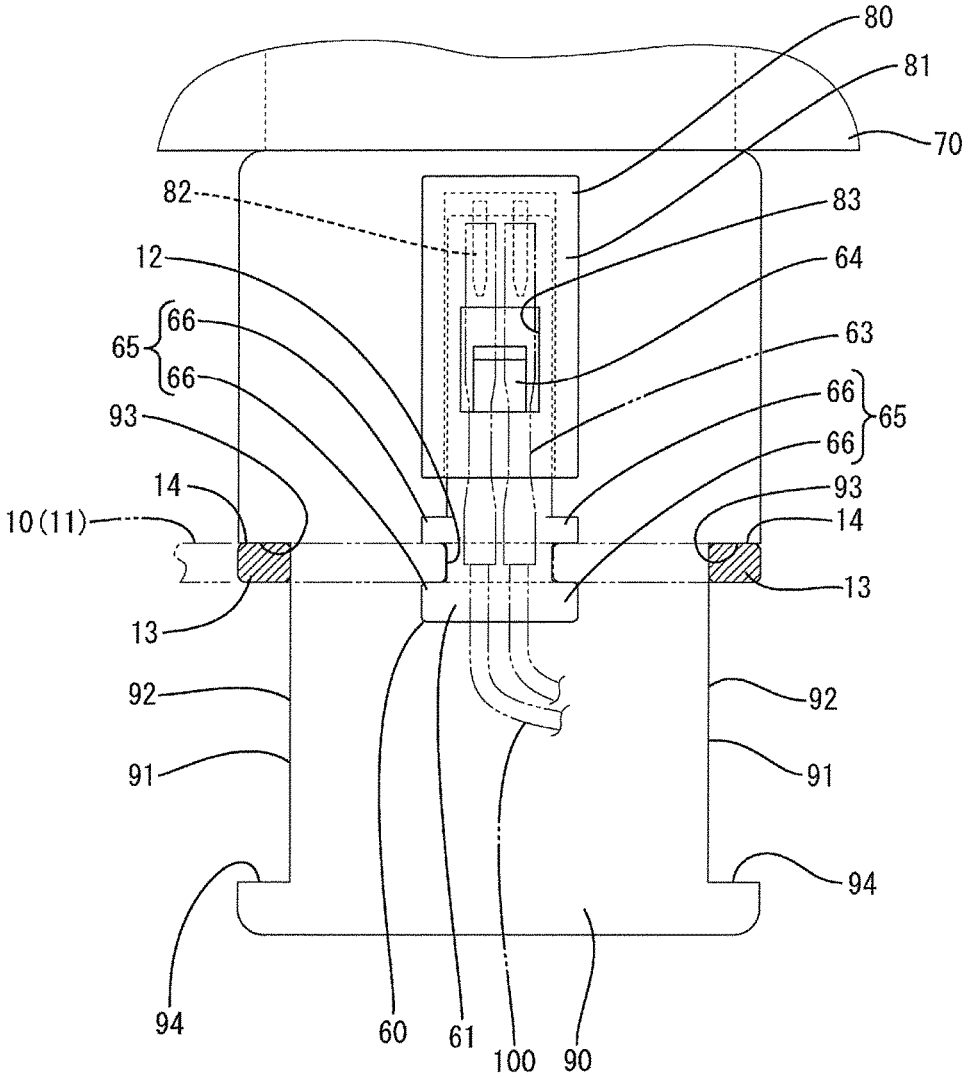
FIG. 7 is a view enlargedly showing a connecting structure of a pair of the holding-side connector and the device-side connector in FIG. 6.
Figure 8:
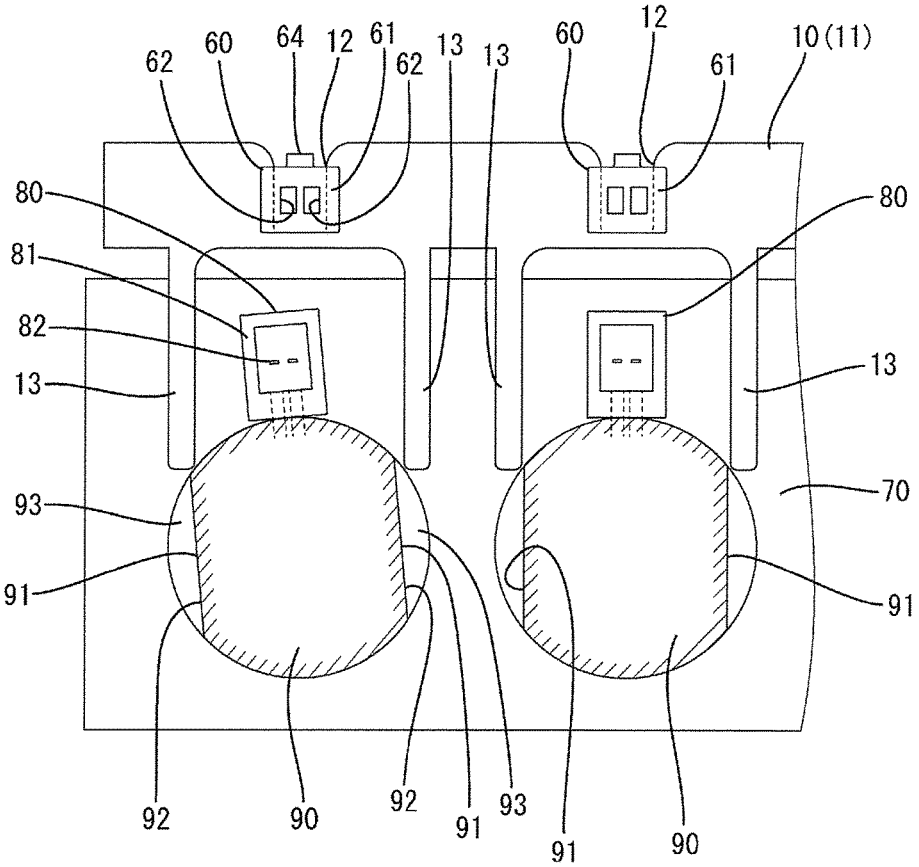
FIG. 8 is a view showing a state where the movement of the electrical device is restricted by the connector connecting member.

As shown in FIG. 7, areas of the outer peripheral surface of the solenoid 90 on both widthwise sides and a substantially rear half are cut to provide two restriction receiving portions 91. The restriction receiving portions 91 have flat back surfaces 92 with a rectangular planar shape and are parallel to each other along the vertical direction. Stopper receiving surfaces 93 having an arcuate planar shape are arranged along the width direction to be perpendicular to the front ends of the back surfaces 92 and facing surfaces 94 are arranged parallel to the stopper receiving surfaces 93 to be perpendicular to the rear ends of the back surfaces 92.

The device-side connector 80 is provided integrally in an area of the outer peripheral surface of the solenoid 90 on an upper end and a substantially front half. The device-side connector 80 includes a receptacle 81 that is made of synthetic resin and is formed into a rearwardly-open rectangular tube. Two tab-like device-side terminals 82 project into the receptacle 81. End parts of the device-side terminals 82 that are opposite to the ends projecting into the receptacle 81 and are connected electrically to coils accommodated in the solenoid 90. Further, a substantially rectangular lock hole 83 is provided to penetrate vertically through the upper wall of the receptacle 81.

Figure 10:
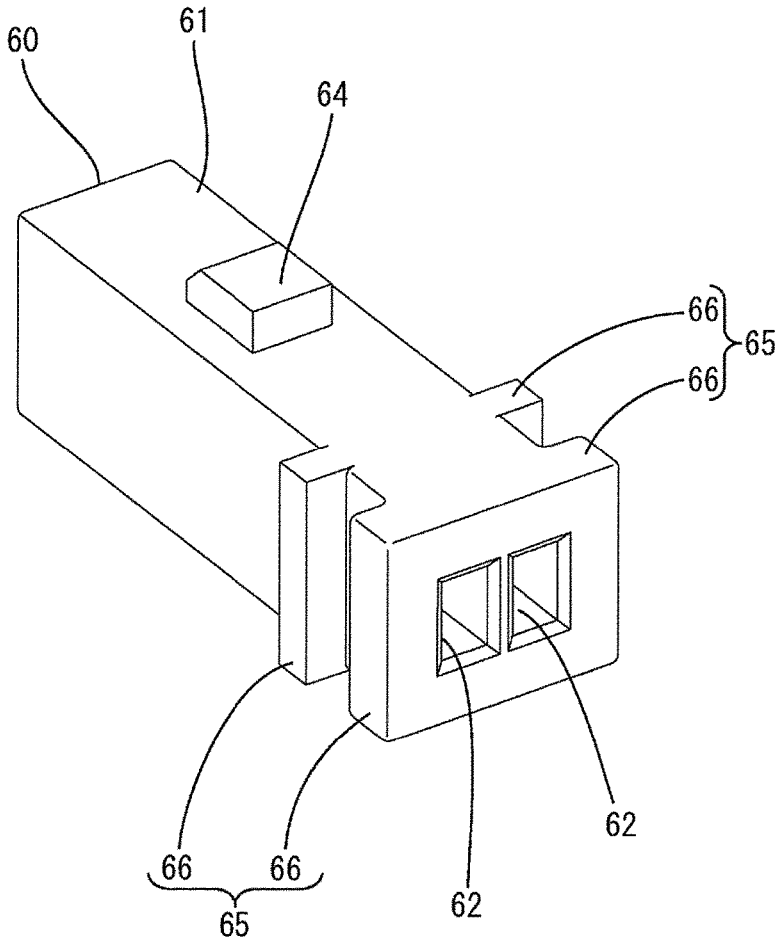
FIG. 10 is a perspective view of a housing of the holding-side connector.

The holding-side connector 60 includes a housing 61 made of synthetic resin. As shown in FIG. 10, the housing 61 is a rectangular block long in the front-rear direction. Two cavities 62 are provided in the width direction inside the housing 61. The cavity 62 penetrates through the housing 61 in the front-rear direction and a holding-side terminal 63 (see FIG. 7) is inserted and accommodated therein. The holding-side terminal 63 is formed such as by bending a long and narrow conductive metal plate. A front end part of the holding-side terminal 63 has a tubular shape and the device-side terminal 82 is inserted therein to be connected at the time of connection. On the other hand, a rear end part of the holding-side terminal 63 is in the form of an open barrel and electrically and mechanically connected to an end part of a wire 100.

A lock 64 projects on the upper surface of the housing 61. The lock projection 64 is inserted into the receptacle 81 in a connecting process to deflect and deform the upper wall of the receptacle 81. The deflected state of the upper wall is released at the time of proper connection and the lock 64 is fit into the lock hole 83 to hold the holding-side connector 60 and the device-side connector 80 in a state where separation is restricted. Two engaging portions 65 protrude on rear end sides of both side surfaces of the housing 61. Each engaging portion 65 is constituted by front and rear ribs 66 extending in parallel to each other in the vertical direction. The rear rib 66 is arranged such that the rear surface is continuous and flush with the rear surface of the housing 61. Both side edges of a later-described connector holding portion 12 can fit into grooves having a rectangularly recessed cross-section defined between the front and rear ribs 66.

Figure 11:
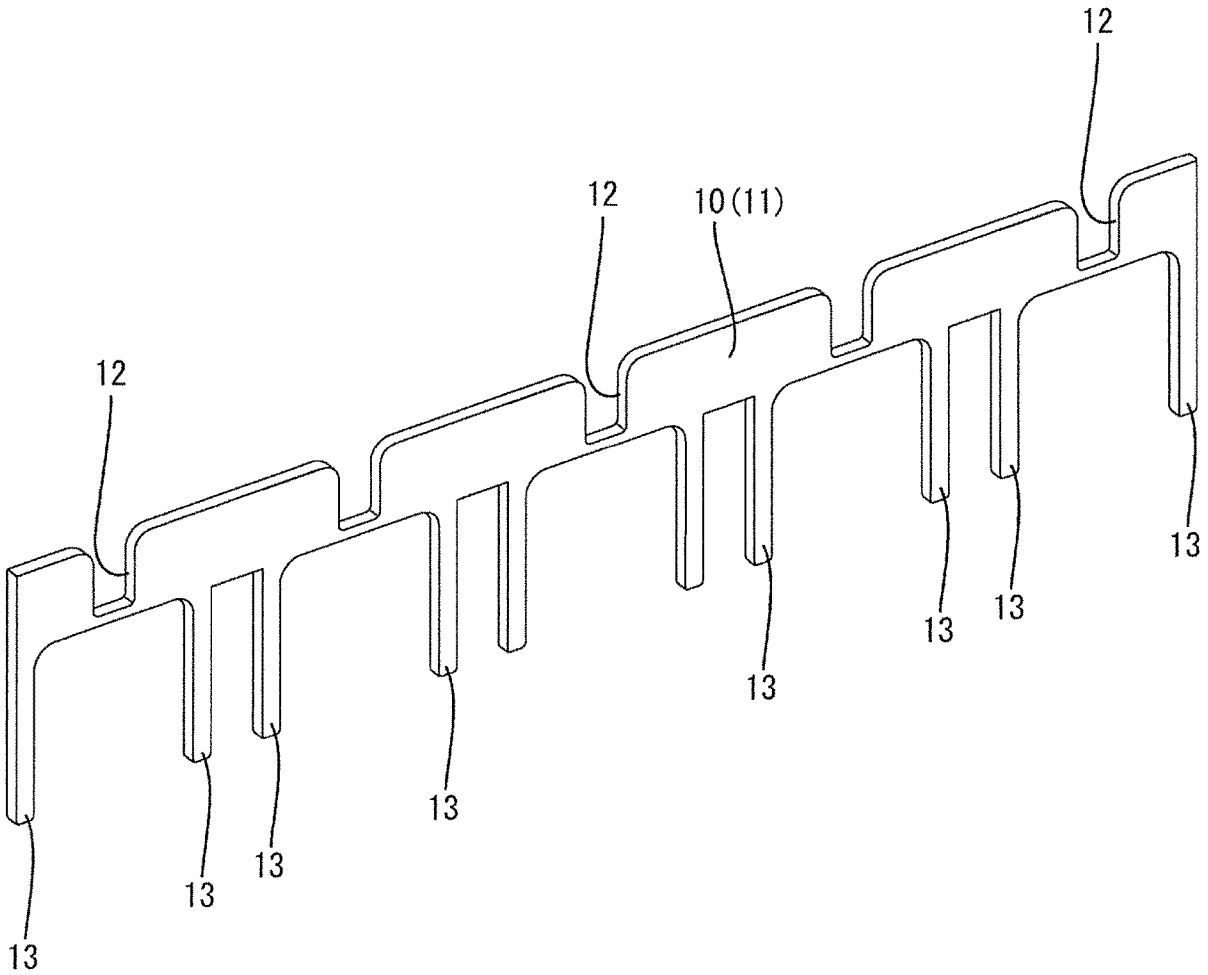
FIG. 11 is a perspective view of the connector connecting member.

The connector connecting member 10 is made of metal and constituted by a plate 11 long in the width direction, as shown in FIG. 11. The plate 11 is formed by stamping a flat plate and is arranged entirely along the width direction and the vertical direction while the plate surfaces thereof are facing in the front-rear direction. That is, the plate 11 has no part bent in the front-rear direction. Further, the plate 11 has a plate thickness slightly larger than a dimension between the front and rear ribs 66 in the housing 61.

Figure 9:
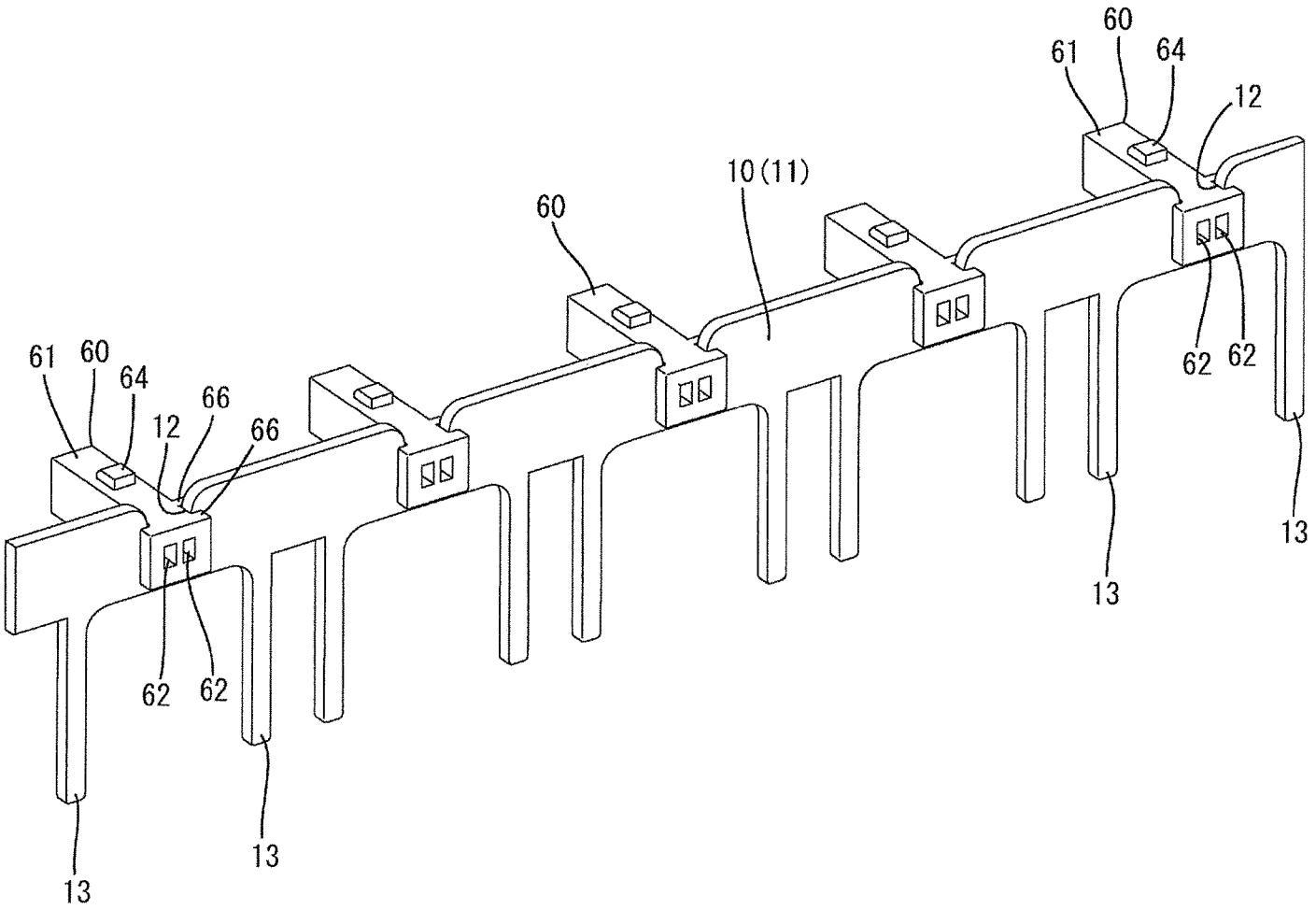
FIG. 9 is a perspective view showing a state where the holding-side connectors are held by the connector connecting member.

The upper end edge (one side edge along the width direction) of the plate 11 is recessed at intervals in the width direction to provide a plurality of the connector holding portions 12. The respective connector holding portions 12 are arranged at specified intervals to correspond to intervals between the respective device-side connectors 80 with the respective solenoids 90 assembled with the body 70. Further, each connector holding portion 12 has a rectangular opening when viewed in the front-rear direction, and the housing 61 is inserted therein from above. As shown in FIG. 9, the housing 61 is held on the plate 11 with both side edge parts (both sides of a recess) of the connector holding portion 12 inserted between the front and rear ribs 66.

Restrictions 13 project at intervals in the width direction on the lower end edge (other side edge facing one side edge and extending along the width direction) of the plate 11. The respective restrictions 13 are arranged at intervals corresponding to a separation distance in the width direction between the restriction receiving portions 91 (distance between the back surfaces 92) in the solenoid 90 at both sides across the connector holding portions 12 in the width direction. The restrictions 13 paired across the connector holding portion 12 are arranged at a large separation distance from each other in the width direction, and the restrictions 13 paired between adjacent connector holding portions 12 are arranged at a small separation distance from each other in the width direction. Further, the restriction 13 is a long narrow strip projecting in the vertical direction along the plate surfaces of the plate 11. The front surface (front plate surface) of the restriction 13 is configured as a stopper surface 14 extending along the vertical direction. Note that the lower end edge of the plate 11 is arranged along the width direction except at parts corresponding to the respective restrictions 13 and, similarly, the upper end edge of the plate 11 is arranged along the width direction except at parts corresponding to the respective connector holding portions 12.

Next, a method for connecting the holding-side connectors 60 and the device-side connectors 80 utilizing the connector connecting member 10 structured as described above and the connector connecting structure are described.

First, the holding-side connectors 60 are inserted into the connector holding portions 12 of the plate 11 (see FIG. 9). In the process of inserting the holding-side connector 60, the side edge parts of the connector holding portion 12 slide between the front and rear ribs 66 in the engaging portions 65 of the housing 61 and a mounting operation of the holding-side connector 60 onto the plate 11 is guided. When the insertion of the holding-side connector 60 is completed, the housing 61 is fit between the front and rear ribs 66 over the entire height, and the holding-side connector 60 is held on the plate 11. However, the holding-side connector 60 is movable in the range of clearances between the front and rear ribs 66.

The plate 11 is located above the respective solenoids 90 after the corresponding holding-side connectors 60 are inserted into the connector holding portions 12. At this time, the plate 11 is positioned roughly so that widthwise central parts of the solenoids 90 are located below the connector holding portions 12 (see FIG. 1). In that state, the plate 11 is lowered. In the process of lowering the plate 11, the restrictions 13 paired across the connector holding portions 12 are slidable on the back surfaces 91 of the restriction receiving portions 91 of the solenoids 90 and each solenoid 90 is located to be sandwiched in the width direction between two restrictions 13. Here, if the solenoid 90 is rotated about an axis from a proper position (see FIG. 8), the restrictions 13 slide on the back surfaces 92 of the restriction receiving portions 91 after sliding on the outer peripheral surface of the solenoid 90, the solenoid 90 rotates to return to the proper position and the back surfaces 92 of the restriction receiving portions 91 are arranged to extend along the vertical direction as the plate 11 is lowered. In this way, the posture of the solenoid 90 is corrected and the movement (rotation) of the solenoid 90 is restricted by being restrained between the two restrictions 13.

Figure 2:
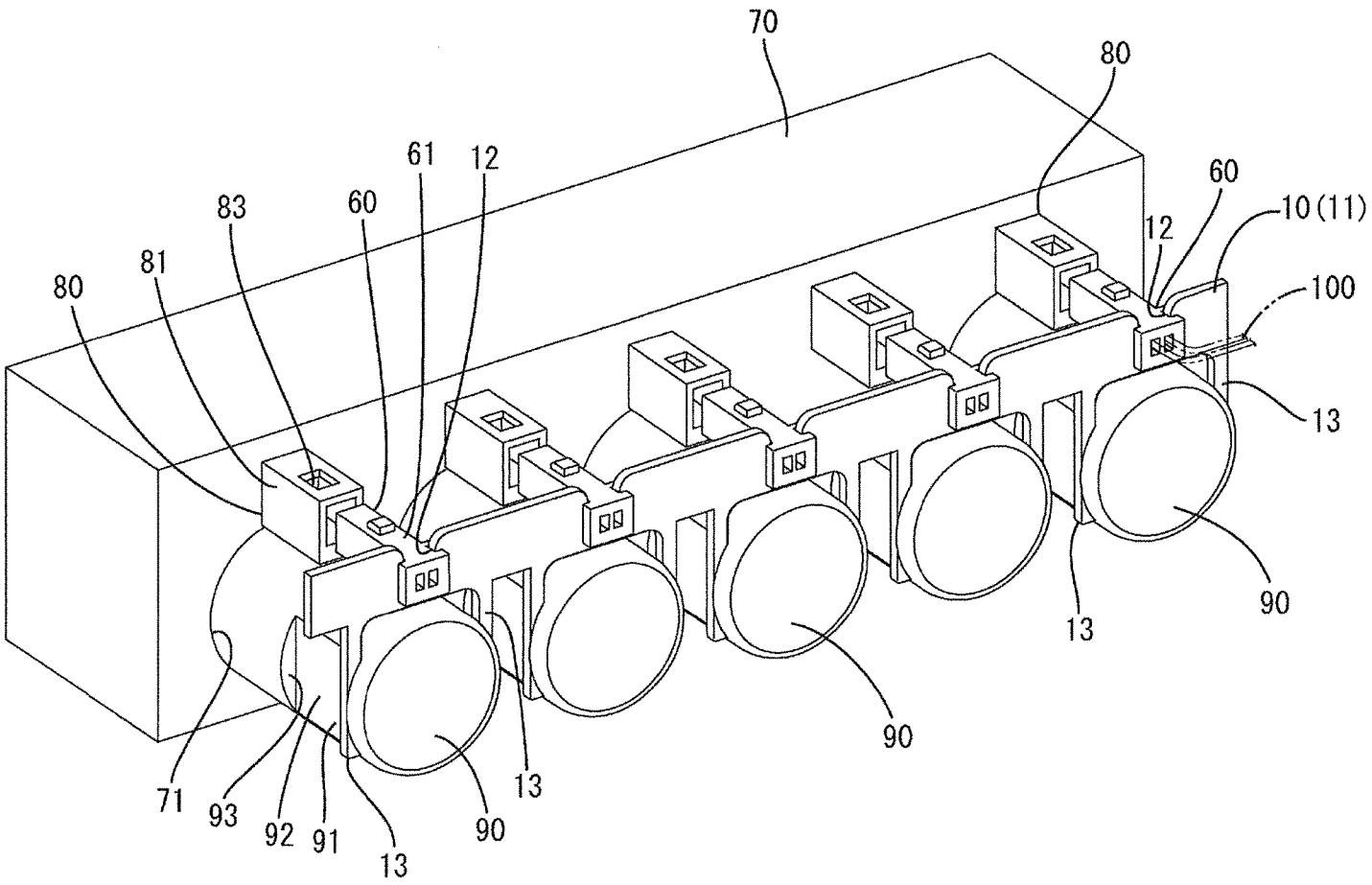
FIG. 2 is a perspective view showing a state where restricting portions of the connector connecting member come into contact with the electrical devices from the state of FIG. 1 to restrict movements of the electrical devices.
Figure 3:
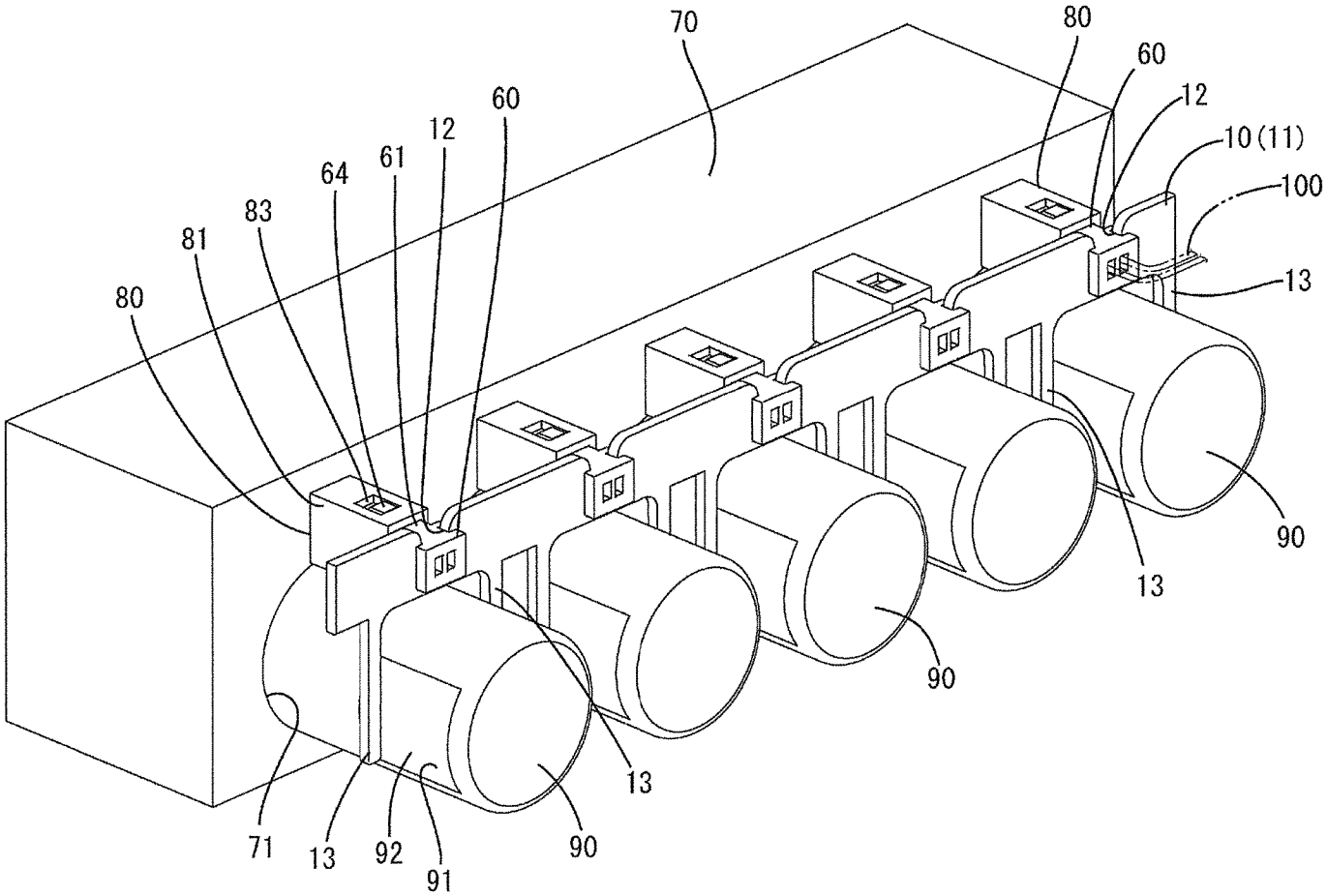
FIG. 3 is a perspective view showing a state where the holding-side connectors and the device-side connectors are properly connected from the state of FIG. 2.
Figure 4:
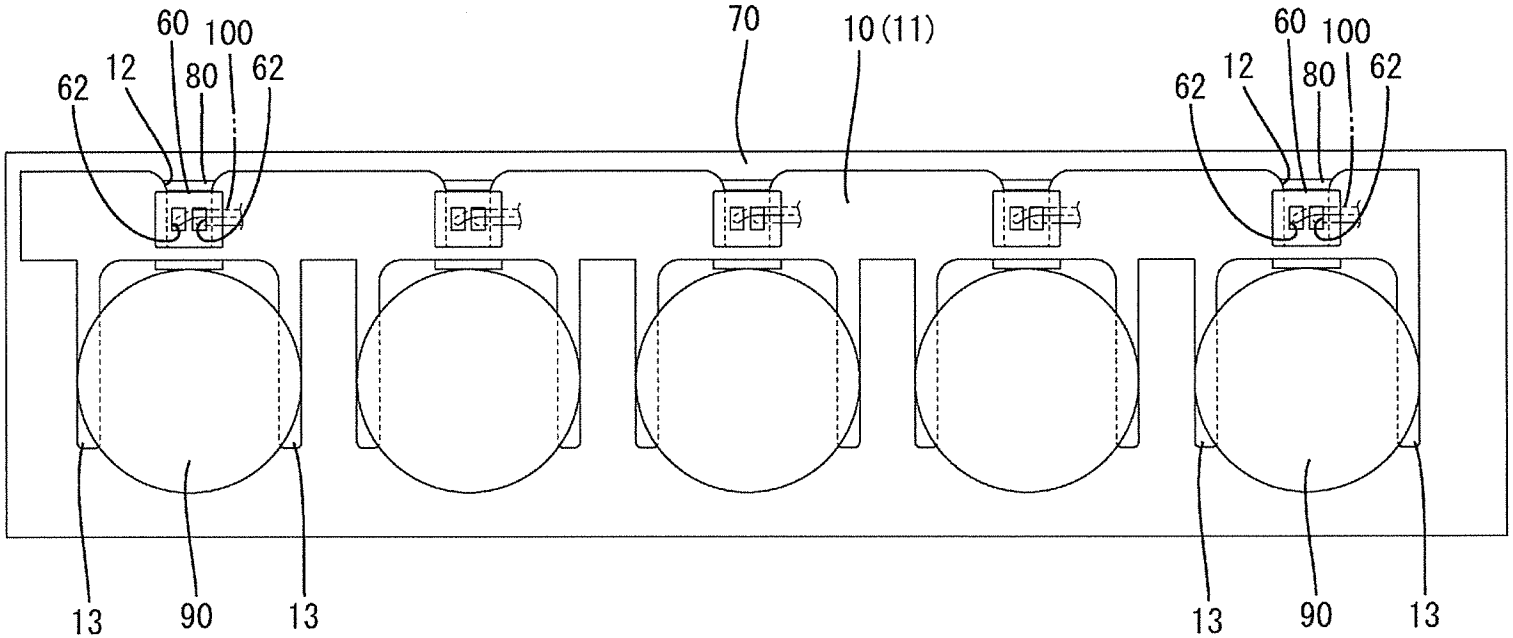
FIG. 4 is a rear view showing the state of FIG. 3.
Figure 5:
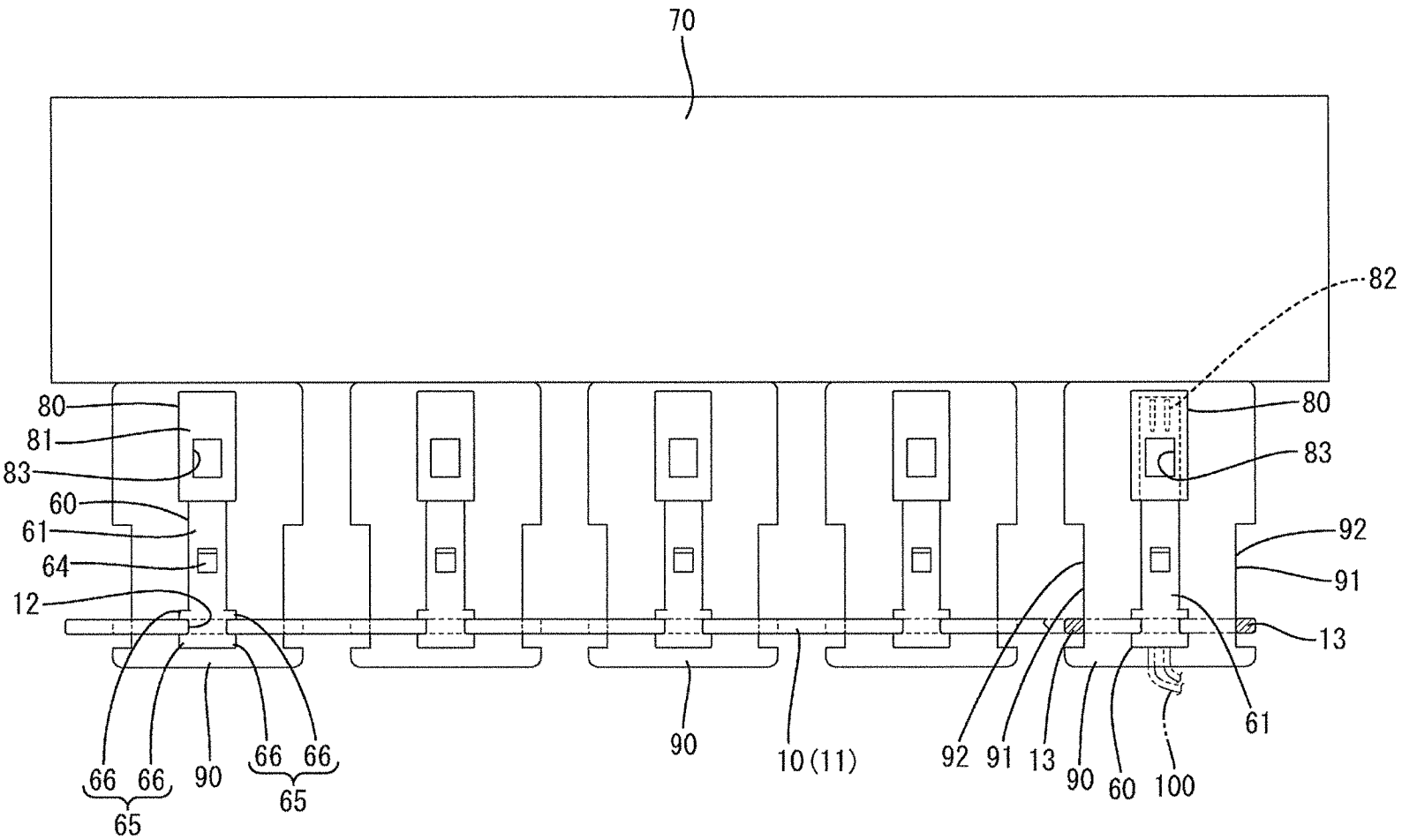
FIG. 5 is a top view showing the state of FIG. 2.
Figure 6:
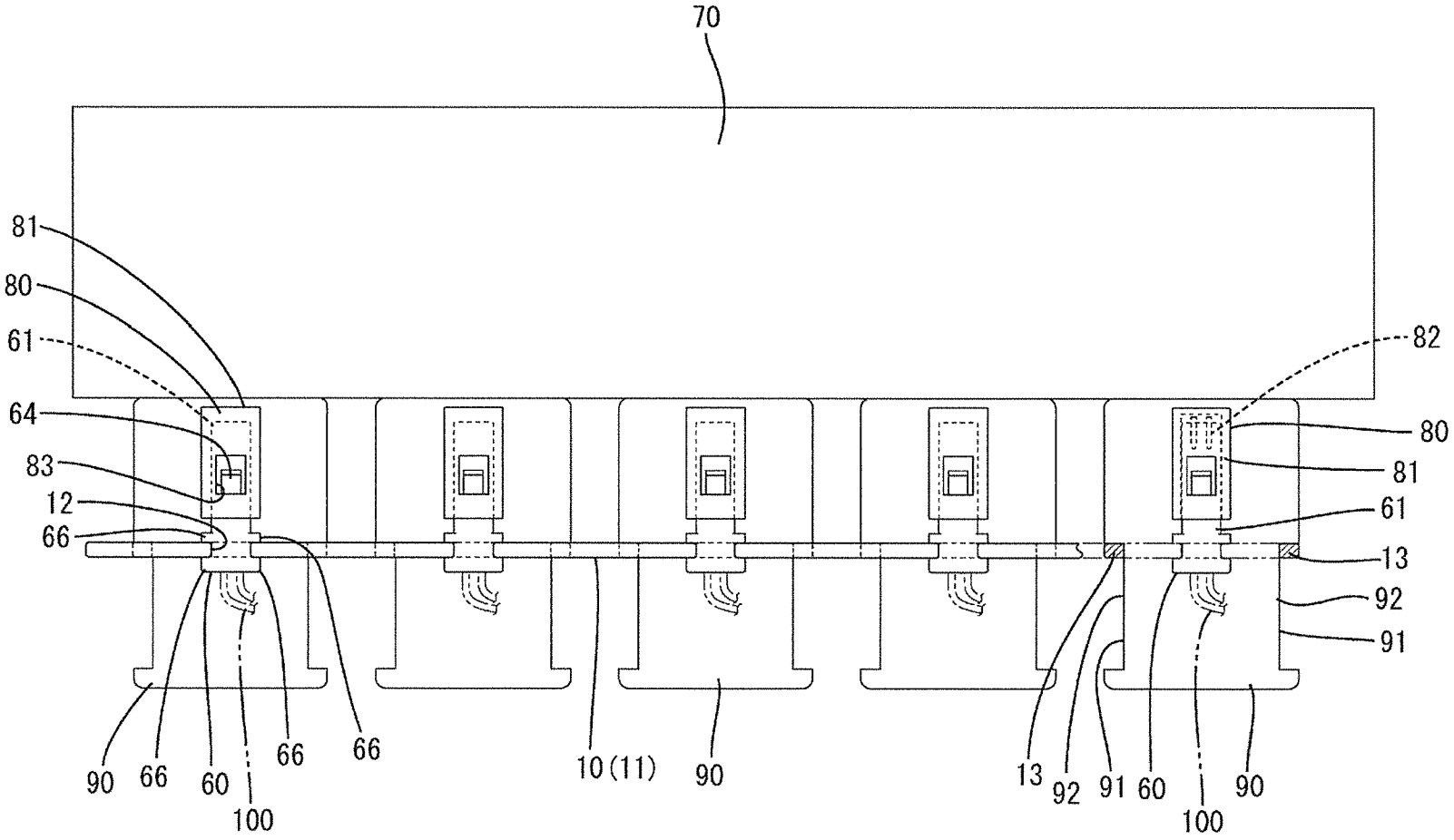
FIG. 6 is a top view showing the state of FIG. 3.

When the plate 11 is lowered to a proper position, the holding-side connectors 60 held by the respective connector holding portions 12 reach positions opposed to the device-side connectors 80 provided in the solenoids 90 in the front-rear direction (see FIG. 2). In that state, the plate 11 is moved forward. In the process of moving the plate 11, the restrictions 13 can slide on the back surfaces 92 of the restriction receiving portions 91. Thus, the solenoids 90 are maintained in a rotationally restricted state between two restrictions 13 and, simultaneously, the holding-side connectors 60 are maintained in a state opposed to the device-side connectors 80.

When the plate 11 moves farther forward, the stopper surfaces 14 of the restrictions 13 come into surface contact with the stopper receiving surfaces 93 of the restriction receiving portions 91 to restrict any further forward movement of the plate 11 (see FIG. 7). Further, the housings 61 of the holding-side connectors 60 are inserted into the receptacles 81 of the device-side connectors 80. At this time, the housings 61 move in the range of clearances to the connector holding portions 12, thereby being smoothly guided into the receptacles 81. With the forward movement of the plate 11 restricted, the housings 61 are inserted to a proper depth in the receptacles 81, the lock projections 64 are fit in the lock holes 83, the holding-side connectors 60 are held in the device-side connectors 80 in a state where separation is restricted, and the holding-side terminals 63 are connected electrically to the device-side terminals 82. In this way, as the plate 11 moves, the holding-side connectors 60 held by the respective connector holding portions 12 are connected substantially simultaneously to the corresponding device-side connectors 80 at once. Thereafter, the plate 11 is sandwiched between each holding-side connector 60 and each solenoid 90 and an assembled state is held.

As described above, the holding-side connectors 60 are held by the respective connector holding portions 12 of the plate 11 and, in that state, the entire plate 11 is brought closer to the device-side connectors 80 provided in the respective solenoids 90. Thus, the respective holding-side connectors 60 can be connected collectively to the respective device-side connectors 80. In this case, the respective restrictions 13 of the plate 11 come into contact with the restriction receiving portions 91 to restrict movements of the solenoids 90 and the respective holding-side connectors 60 are aligned at positions connectable to the corresponding device-side connectors 80. Thus, a connecting operation of the respective holding-side connectors 60 and the respective device-side connectors 80 can be performed quickly and easily.

Further, since the restrictions 13 are arranged at both sides across the connector holding portions 12 in the width direction, the movements of the solenoids 90 can be reliably restricted by sandwiching the solenoids 90 from both sides in the width direction. Further, the structure of the entire plate 11 does not become complicated.

The entire connector connecting member 10 is constituted by the long plate 11, the connector holding portions 12 are recesses open at intervals on the upper edge of the plate 11, and the restrictions 13 project along the plate surfaces of the plate 11 from the lower edge of the plate 11. Thus, the connector holding portions 12 and the restrictions 13 having a simple structure are collectively provided on the long plate 11. As a result, the structure of the plate 11 needs not be complicated.

Furthermore, the stopper surfaces 14 of the restrictions 13 come into contact with the stopper receiving surfaces 93 of the restriction receiving portions 91. Thus, further forward movement of the plate 11 is restricted and the separation of the plate 11 and the respective holding-side connectors 60 from the respective device-side connectors 80 can be prevented.

The respective holding-side connectors 60 are held by the connector holding portions 12 and an aligned state thereof is maintained also after being connected to the respective device-side connectors 80, the stability of the connected state can be ensured.

Other embodiments of the present invention are briefly described.

The connector connecting member may move only in one direction toward the device-side connectors.

The connector connecting member may be separated from the respective holding-side connectors after the respective holding-side connectors are connected to the device-side connectors.

The device-side connector may be provided in an electrical device other than the solenoid such as a hydraulic pressure sensor of the automatic transmission.

The connector connecting member may be constituted by a plate having a part bent in the front-rear direction.

The connector connecting member may be in the form of a block instead of in the form of a plate.

The connector connecting member may be provided with a wire accommodating portion for accommodating the wires pulled out from the respective holding-side connectors.

The restricting portions paired at both sides of the connector holding portion may be inclined to be more separated toward the tips and formed to guide the outer peripheral surface of the solenoid (electrical device).

One restricting portion may come into contact with one solenoid (electrical device) to restrict the movement of the solenoid.

LIST OF REFERENCE SIGNS

10 . . . connector connecting member
11 . . . plate
12 . . . connector holding portion

13 . . . restrict
14 . . . stopper surface
60 . . . holding-side connector
80 . . . device-side connector
90 . . . solenoid (electrical device)

The invention claimed is:

1. A connector connecting member for connecting holding-side connectors to device-side connectors provided in electrical devices, comprising:

connector holding portions arranged side by side in a direction intersecting a connecting direction of the device-side connectors and the holding-side connectors and configured to hold the holding-side connectors; and restricting portions arranged adjacent to the connector holding portions and configured to restrict movements of the electrical devices by contacting the electrical devices and aligning the holding-side connectors at positions connectable to the device-side connectors;

the restricting portions being arranged at both sides across the connector holding portions.

2. The connector connecting member of claim 1, wherein the connector connecting member is constituted by a plate, the connector holding portions are recesses open at intervals on one side edge of the plate, and the restricting portions project along plate surfaces of the plate from another side edge facing the one side edge.

3. The connector connecting member of claim 1, wherein the connector connecting member is moved toward the device-side connectors in a connecting process with the holding-side connectors held by the connector holding portions, and the restricting portions have stopper surfaces for stopping a movement of the connector connecting member by coming into contact with the electrical devices.

4. A connector connecting structure, characterized in that the holding-side connectors held by the connector holding portions in the connector connecting member of claim 3 are connected to the corresponding device-side connectors.

5. A connector connecting structure, characterized in that the holding-side connectors held by the connector holding portions in the connector connecting member of claim 1 are connected to the corresponding device-side connectors.

* * * * *